US008731430B2

(12) United States Patent
Hatano

(10) Patent No.: US 8,731,430 B2
(45) Date of Patent: May 20, 2014

(54) CHARGING DEVICE

(75) Inventor: Fukashi Hatano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 13/563,369

(22) Filed: Jul. 31, 2012

(65) Prior Publication Data

US 2013/0034367 A1 Feb. 7, 2013

(30) Foreign Application Priority Data

Aug. 5, 2011 (JP) ..... 2011-171995

(51) Int. Cl.
*G03G 15/02* (2006.01)

(52) U.S. Cl.
CPC ..... *G03G 15/0225* (2013.01); *G03G 15/02* (2013.01)
USPC ..... 399/100

(58) Field of Classification Search
CPC ..... G03G 15/0225; G03G 15/02
USPC ..... 399/100, 170–173
See application file for complete search history.

(56) References Cited

U.S. PATENT DOCUMENTS 7,623,806 B2 * 11/2009 Tanase ..... 399/100
7,769,315 B2 * 8/2010 Tanaka ..... 399/100

FOREIGN PATENT DOCUMENTS

JP 9-119499 A 5/1997

* cited by examiner

*Primary Examiner* — Hoang Ngo
(74) *Attorney, Agent, or Firm* — Canon USA Inc IP Division

(57) ABSTRACT

In a configuration in which a carriage jumps at an end of a screw without using a sensor for detecting a position, when a load for moving the carriage in a longitudinal direction is increased, the carriage jumps at an unintended position of a charging wire. An urging member is regulated not to be displaceable greater than a difference between a concave portion and a convex portion of the screw when the regulation member is at a regulation position, and is displaceable greater than the difference between the concave portion and the convex portion of the screw when the regulation member is at a retreat position.

4 Claims, 11 Drawing Sheets

LOCKED STATE (NO JUMPING)

DURING RELIEF

RELEASED STATE (JUMPING)

CHARGING DEVICE

BACKGROUND OF THE INVENTION

1. Field of the Invention

The present invention relates to a charging device including a mechanism for moving a cleaning member configured to clean a charging electrode in a corona charging device in a longitudinal direction by a screw.

2. Description of the Related Art

An electrophotographic image forming apparatus using a corona charging device configured to apply a voltage to a charging wire to charge a photosensitive member by corona discharge has been known. When the charging wire is contaminated with dust or toner, a surface potential of the photosensitive member becomes non-uniform, causing image failure called image unevenness, in addition to a decrease in charging efficiency of the photosensitive member.

A corona charging device including a mechanism for moving a cleaning pad for cleaning a charging wire in a longitudinal direction with a screw, to clean the charging wire has been discussed. In a configuration in which the cleaning pad cleans the charging wire, charging failure occurs when the cleaning pad stops at the center of the charging wire (a photosensitive member charging area).

Therefore, in a configuration in which a carriage, which engages with a screw without jumping, moves a cleaning pad in a longitudinal direction, a position detection sensor for detecting that the carriage is positioned at an end of the screw can be provided at the end of the screw, to control the carriage to stop at the end of the screw. When the position detection sensor is provided, however, the cost unfavorably rises.

On the other hand, Japanese Patent Application Laid-Open No. 09-119499 discusses a configuration in which a spring urges, toward the screw, a member, which engages with a groove of a screw, in a carriage configured to move a cleaning pad, to allow the member to jump when a predetermined load or more is applied to move the carriage. In a configuration in which the carriage can jump over the entire length of the screw in a longitudinal direction, when the carriage abuts on a wall surface at an end of the screw so that the predetermined load or more is applied thereto, the carriage can jump at the end of the screw to stop without using a sensor. More specifically, if the screw is turned while the carriage contacts the wall surface at the end of the screw, a protrusion, which engages with concave and convex portions of the screw, provided in the carriage jumps a convex portion of the screw, to stop the carriage at the end of the screw.

On the other hand, a charging performance of the corona charging device is required to be improved to improve the productivity of a print product to be output by an image forming apparatus. To improve the charging performance, a voltage to be applied to the charging wire may be increased, or a plurality of charging wires for charging a photosensitive member may be used. When the voltage to be applied to the charging wire is increased to improve the charging performance, the degree of dirt of the charging wire is aggravated in addition to an increase in a required creeping distance (a distance in a longitudinal direction of the corona charging device). In a configuration in which the plurality of charging wires is used, a plurality of cleaning pads is similarly required. When the length and the number of charging wires and the dirt that adheres to the charging wires are increased to improve the productivity of the print product, a torque required to move the cleaning pads for cleaning the charging wires in a longitudinal direction is increased.

In a configuration in which a carriage jumps at an end of a screw while improving a charging performance of a corona charging device to enhance productivity, the following problems occur. Specifically, when a force generated when a cleaning pad serving as a cleaning member is moved in a longitudinal direction is increased due to an increase in the dirt that adheres to a charging wire serving as a charging electrode, a force required for the carriage to move in the longitudinal direction is also increased. When a force to move the carriage in the longitudinal direction becomes predetermined value or more due to the dirt, the carriage jumps in an unintended place (a place other than the end of the screw).

Particularly when a protrusion of the carriage jumps from a helical groove of the screw, and the carriage stops at the center of the corona charging device (a site where an area, where an electrostatic image is to be formed, of a photosensitive member is charged), image failure called a white streak or a black streak occurs.

SUMMARY OF THE INVENTION

The present invention is directed to providing a charging device configured to prevent a carriage from not moving by jumping at the center of a corona charging device in a longitudinal direction while stopping the carriage at an end of a screw without using a sensor.

According to an aspect of the present invention, a charging device includes a corona charging device including a charging electrode, a cleaning member for cleaning the charging electrode, a screw, a carriage, including an engagement portion that engages with a concave portion of the screw, an urging member for urging the engagement portion toward the screw, and a regulation member for regulating deformation of the urging member, wherein the carriage moves the cleaning member in a longitudinal direction of the corona charging device as the screw rotates, and a retreat member configured to abut on the regulation member at an end of the screw and retreat the regulation member from a regulation position to a retreat position, in which the urging member is regulated not to be displaceable greater than a difference between the concave portion and a convex portion of the screw when the regulation member is at the regulation position while being displaceable greater than the difference between the concave portion and the convex portion of the screw when the regulation member is at the retreat position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A first exemplary embodiment will be described. A schematic configuration of an image forming apparatus 100 configured to charge a photosensitive drum D serving as a photosensitive member using a corona charging device P1 serving as a charging device will be described. Thereafter, a corona charging device P1 will be described in detail below.

Figure 1:
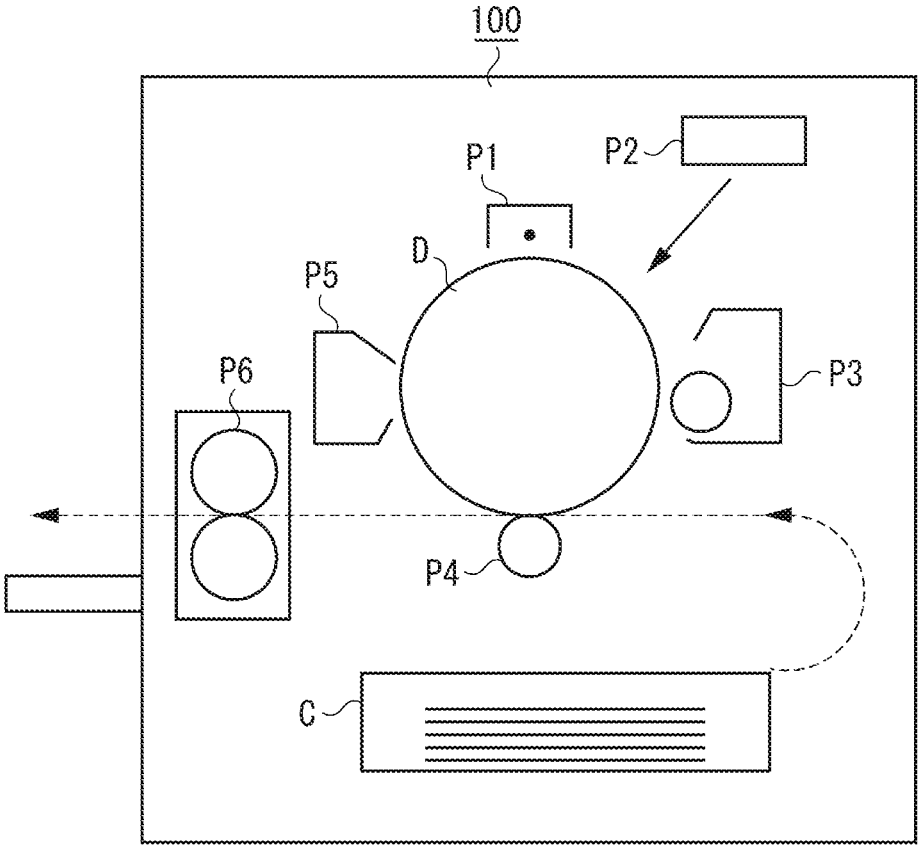
FIG. 1 is a schematic sectional view illustrating an image forming apparatus according to an exemplary embodiment.

FIG. 1 illustrates a schematic configuration of the image forming apparatus 100 according to the present exemplary embodiment. The image forming apparatus 100 includes a cylindrical photosensitive drum D serving as a rotatable photosensitive member, and a corona charging device P1 serving as a charging device configured to charge the photosensitive drum D in a non-contact manner.

A laser scanner P2 serving as an exposure unit forms an electrostatic image on the photosensitive drum D, which has been charged by the corona charging device P1, by exposure in response to an image signal to be input to the image forming apparatus 100.

A development device P3 serving as a development unit develops the electrostatic image, which has been formed on the photosensitive drum D, using toner. A transfer roller P4 serving as a transfer unit transfers a toner image, which has been formed on the photosensitive drum D by the development device P3, onto a recording material that has been conveyed from a cassette C.

A cleaning blade P5 serving as a cleaning unit removes residual transfer toner that has adhered on the photosensitive drum D without being transferred onto the recording material. A fixing device P6 heats and fixes, onto the recording material, the toner image, which has been transferred onto the recording material, and the heated and fixed toner image is discharged to a discharge tray. The image forming apparatus 100 has been schematically described above.

Figure 2:
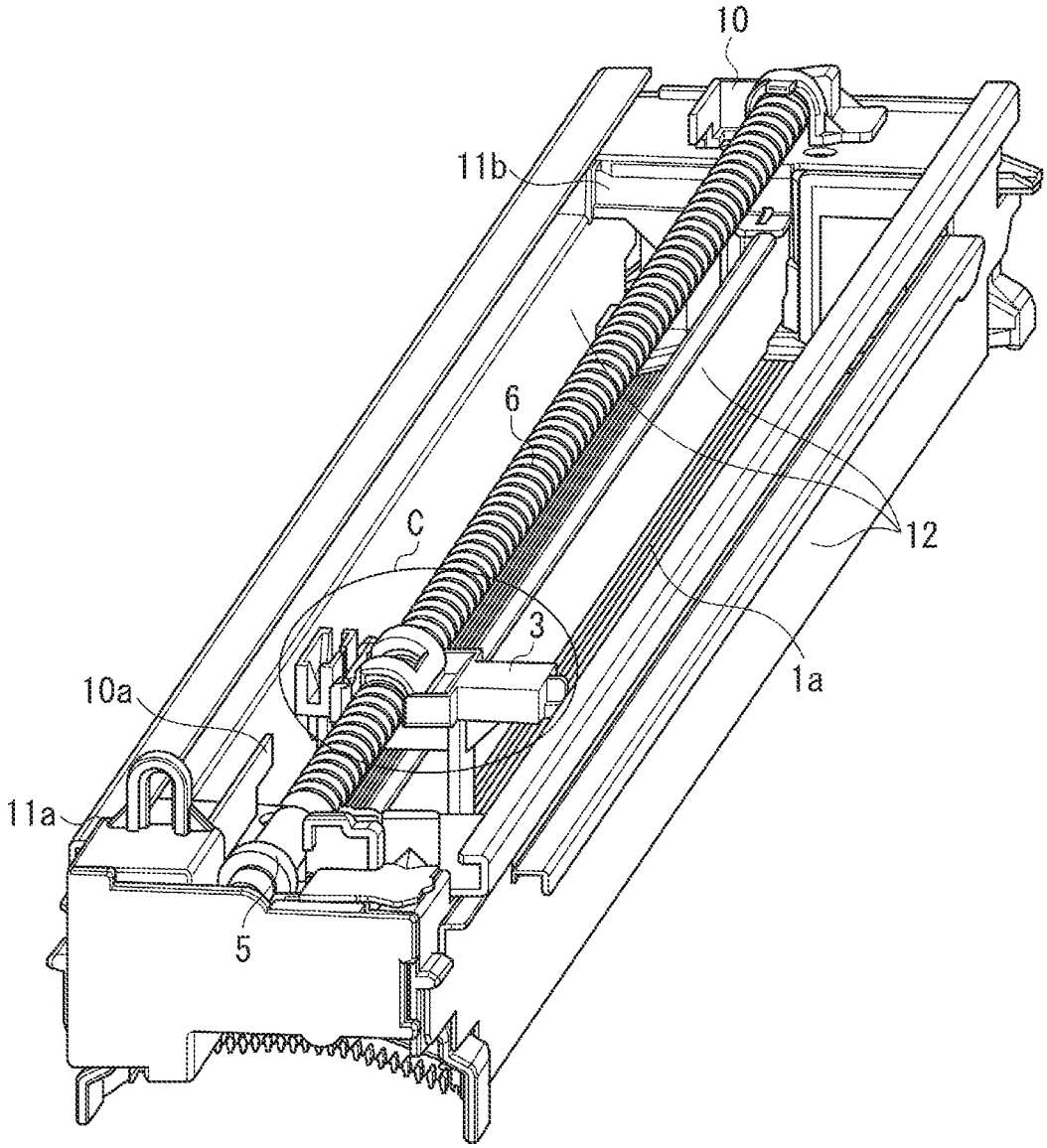
FIG. 2 is a schematic perspective view illustrating a charging device according to the exemplary embodiment.
Figure 3A:
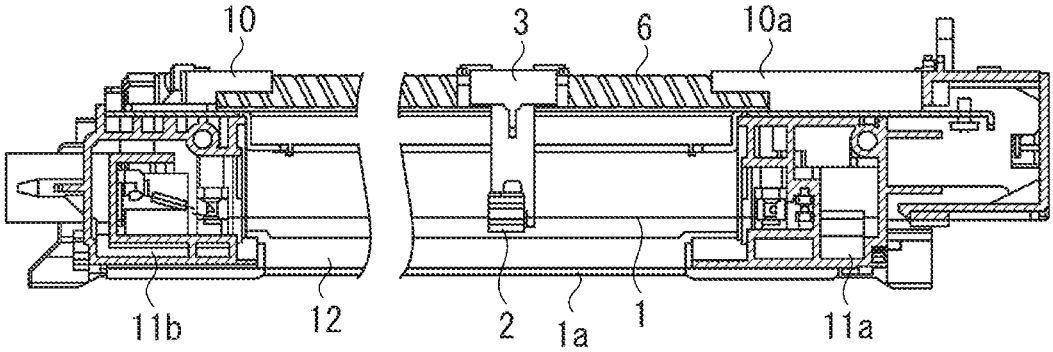
FIGS. 3A and 3B are schematic sectional views illustrating the charging device according to the exemplary embodiment.
Figure 3B:
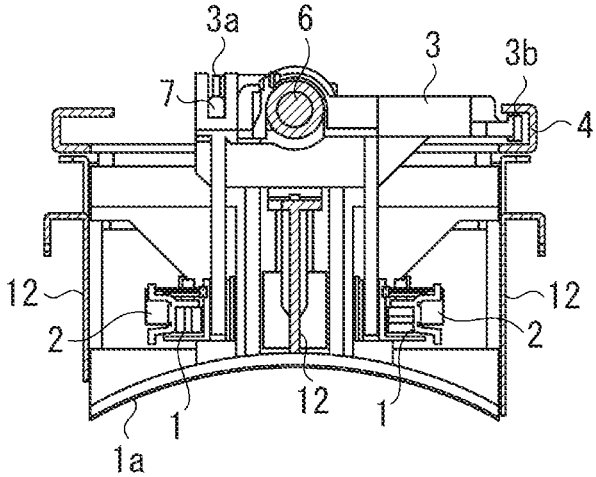
Figure 4:
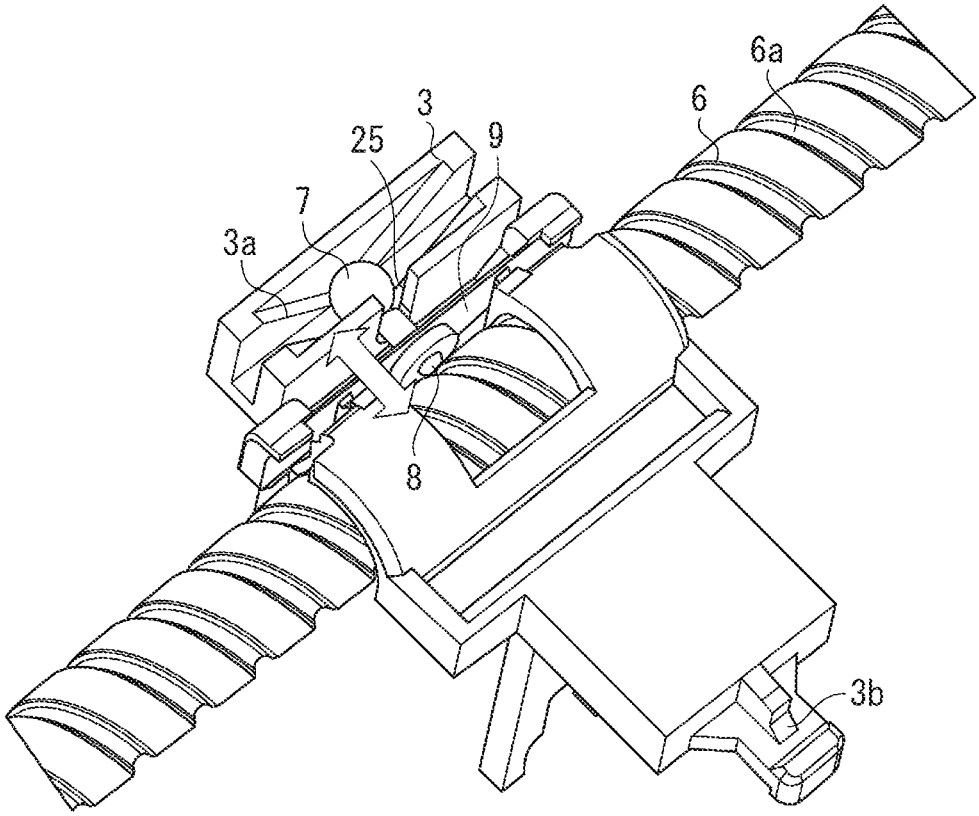
FIG. 4 is a detail view illustrating a carriage according to the exemplary embodiment.

The corona charging device P1 according to the present exemplary embodiment will be described in detail below. FIG. 2 is a perspective view for illustrating the corona charging device P1 serving as the charging device according to the present exemplary embodiment. FIG. 3A is a cross-sectional view in a longitudinal direction of the corona charging device P1, and FIG. 3B is a cross-sectional view in a widthwise direction of the corona charging device P1. FIG. 4 is a detail view for illustrating a configuration of a carriage 3.

In the corona charging device P1 illustrated in FIGS. 2, 3A, and 3B, a charging wire 1 and a grid line 1*a* are stretched between front and rear blocks 11*a* and 11*b* provided at both ends of a shield plate 12. A high voltage of 10 kV and a high voltage of 400 to 900 V are applied to the charging wire 1 and to the grid line 1*a* and the shield plate 12, respectively, from an external terminals (not illustrated), to induce corona discharge between the charging wire 1 and the grid line 1*a* and the shield plate 12. A cleaning pad 2, which is divided into four in vertical and horizontal directions, pinches the charging wire 1. The charging wire 1 is formed of tungsten having a diameter of approximately 60 μm, and the grid line 1*a* is formed of stainless steel (SUS) having a diameter of approximately 100 μm. The cleaning pad 2 serving as a cleaning member is formed of a material having both elasticity and a grinding capability, e.g., rubber containing an abrasive.

A screw 6 having a helical groove 6*a* formed on its round shaft is rotatably supported between the front block 11*a* and the rear block 11*b* above the charging wire 1. The carriage 3 is movably fitted in the screw 6. The screw 6 has a pitch of 5.2 mm. The screw 6 may have a helical convex portion provided on its round shaft. A difference in height between the convex portion of the screw 6 configured to give a driving force in the longitudinal direction to the carriage 3 and a concave portion (a thread portion and a trough portion) serving as a portion to be engaged therewith is 1.5 mm.

The carriage 3 is supported to be movable along the charging wire 1 with a carriage guide 3*b* being guided by a shield plate rail 4 provided on an inner surface of the shield plate 12, and holds the cleaning pad 2. A protrusion 8 serving as an engagement portion is provided in an extended condition in a fitted portion of the carriage 3, and engages with the helical groove 6*a* of the screw 6. The protrusion 8 is attached to a plate spring 9 serving as an urging member. The plate spring 9 is supported on the carriage 3. The protrusion 8 is thus elastically supported on the carriage 3, so that the protrusion 8 serving as an engagement portion is relieved of the screw 6 when a certain force or more is applied during an operation of the carriage 3. It is configured such that the protrusion 8 is relieved, so that the carriage 3 does not receive a driving force for moving in the longitudinal direction of the corona charging device P1, to stop moving.

Here, a spring constant of the plate spring 9 is set so that the protrusion 8 is relieved when a load of 300 gf or more is applied in an operation direction of the carriage 3. Specifically, the plate spring 9 is deformed in a direction away from a rotation center of the screw 6 with the load received by the protrusion 8. When a predetermined load or more is exerted on the carriage 3, the plate spring 9 is deformed so that a distance from the rotation center of the screw 6 to the protrusion 8 that has retreated is greater than a distance from the rotation center of the screw 6 to the convex portion (thread portion) of the screw 6. Thus, a phenomenon called jumping arises, so that the carriage 3 stops where it is without moving by the screw 6 in the longitudinal direction.

When the charging wire 1 is cleaned, the screw 6 is driven to rotate via a drive gear 5 with external power of a motor (not illustrated), to move the carriage 3. At this time, the motor is set to rotate for a little longer than a period of time required for the carriage 3 to perform a forward operation, which is found from the number of rotations of the motor and the pitch of the screw 6. Even if there is no sensor for determining a stop position of the carriage 3, therefore, the carriage 3 abuts on the front and rear blocks 11*a* and 11*b*, and automatically stops by the protrusion 8 jumping from the screw 6. More specifically, even if the motor rotates, so that the screw 6 rotates, the carriage 3 can be stopped at an end of the screw 6.

A central processing unit (CPU) (not illustrated) serving as a control unit provided in the image forming apparatus 100 controls execution of a cleaning mode of a charging electrode and management of a rotation time of the motor. A rotational direction of the motor is then reversed so that the carriage 3 can perform a backward operation. At this time, the rotation time of the motor is also set a little longer. Since the number of rotations of the screw 6 is 400 rpm, the pitch of the screw 6 is 5.2 mm, and the movement distance of the carriage 3 is 340 mm, it takes approximately 10 seconds each way for the carriage 3 to move. Accordingly, the rotation time of the motor is set to approximately 12 seconds.

The corona charging device P1 has been described above. A configuration of the carriage 3 will be described in detail below.

A detailed configuration of the carriage 3 will be described below with reference to FIG. 4. The carriage 3 according to the present exemplary embodiment includes an assist ball 7 serving as a regulation member on the side farther away from the rotation center of the screw 6 with respect to the plate spring 9 serving as an urging member. The assist ball 7 serving as a regulation member for regulating the movement of an abutment portion has a spherical shape, and is guided by an assist rail 3*a* provided in the carriage 3 to roll in the operation direction of the carriage 3.

The assist rail 3*a* has a V shape, and the assist ball 7 moves toward a V-shaped valley portion under its own weight. A groove 25 is formed on a wall surface, on the side of the protrusion 8, of the assist rail 3*a*. The assist rail 3*a* extends to a position where a back surface of the protrusion 8 come s into contact with the assist ball 7 through the groove 25.

The assist ball 7 is thus positioned on the back surface of the protrusion 8, so that the plate spring 9 cannot be deflected even if a certain force or more is applied to the carriage 3. Therefore, the protrusion 8 is not relieved of the screw 6 (in a direction indicated by an arrow). More specifically, if the assist ball 7 serving as a regulation member is in the valley portion (at a regulation position), the movement of the protrusion 8 in a direction away from the rotation center of the screw 6 beyond the convex portion of the screw 6 is regulated. On the other hand, if the assist ball 7 serving as a regulation member abuts on the protrusion 8 on the side of the main body of the image forming apparatus 100 to retreat toward a portion other than the valley portion (a retreat position), the protrusion 8, which has been deregulated, can move in a direction away from the rotation center of the screw 6 beyond the convex portion of the screw 6. More specifically, the protrusion 8, which has been urged toward the rotation center of the screw 6 by the plate spring 9 serving as an urging member, is regulated not to be movable (displaceable) by 1.5 mm or more, which is a difference between the concave and convex portions of the screw 6, outward from a position where it is urged toward the helical groove 6*a* of the screw 6 when the assist ball 7 is at the regulation position.

A slit is provided in the operation direction of the carriage 3 (the longitudinal direction of the corona charging device P1) at the center of the assist guide 3*a*. How the assist ball 7 operates when the carriage 3 is at the end of the screw 6 and at the center of the screw 6 will be described with reference to FIGS. 5A and 5B and FIGS. 6A and 6B. In the present exemplary embodiment, the end of the screw 6 means a site where the assist ball 7 serving as a regulation member and a retreat plate 10 serving as a retreat member contact each other. The center of the screw 6 means a site where the assist ball 7 and the retreat plate 10 do not contact each other.

Figure 5A:
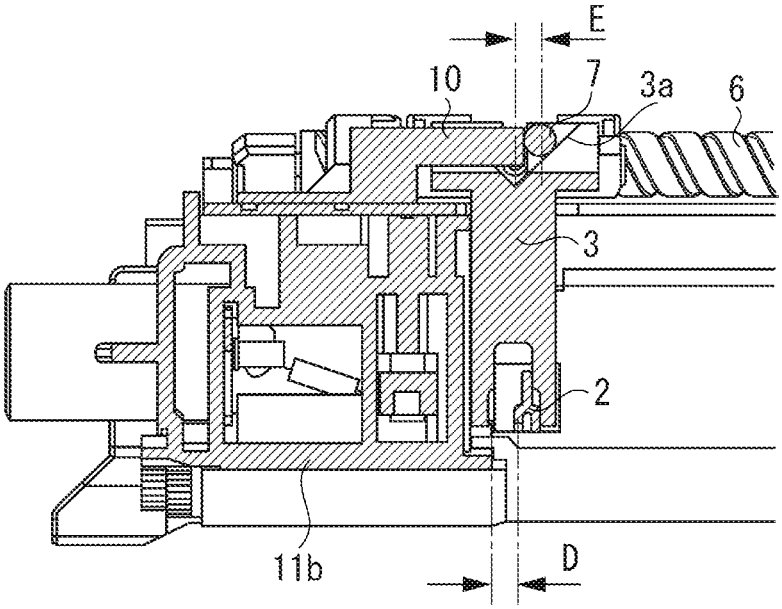
FIGS. 5A and 5B are a side view and a top view illustrating the carriage according to the exemplary embodiment.
Figure 5B:
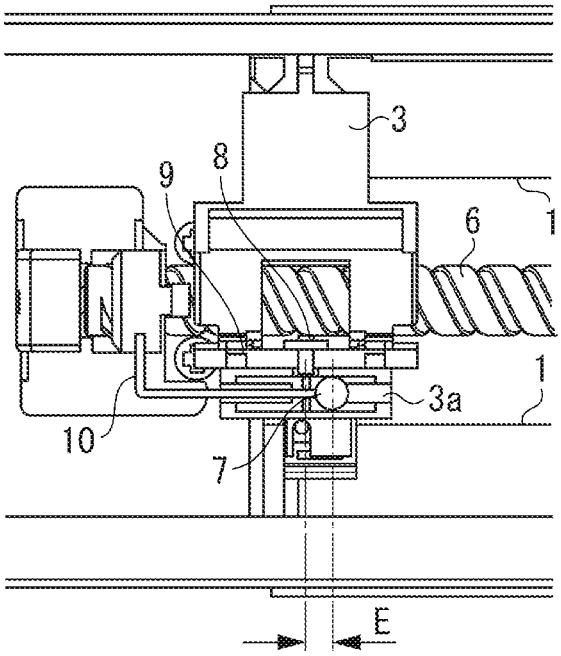

FIG. 5A is a sectional side elevation in a state where the carriage 3 is operated from the front block 11*a* toward the rear block 11*b*, to abut on the rear block 11*b*. FIG. 5B is an top plan view in the vicinity of the carriage 3 in the above state. As apparent from FIG. 1, a direction from the charging wire 1 in the corona charging device P1 toward an opening of the corona charging device P1 (or the photosensitive drum D) is downward in a direction of gravity. The assist ball 7 receives an urging force due to gravity, to roll toward a position of V-shaped lowermost portion (valley portion) when the assist ball 7 does not abut on the protrusion 8. The V-shaped groove 25 may be replaced with a spring to move the assist ball 7, which remains unabutted on the retreat plate 10 depending on an arrangement of the corona charging device P1, toward the regulation position.

When the carriage 3 reaches a position where it abuts on the rear block 11*b* (the end of the screw 6), the retreat plate 10 serving as a retreat member provided above the rear block 11*b* enters the slit of the assist rail 3*a*. The retreat plate 10, which has entered the slit, abuts on the assist ball 7 serving as a regulation member, to push away the assist ball 7 from a back surface portion (a regulation position) of the protrusion 8. The protrusion 8 can be relieved of the screw 6 when the assist ball 7 does not exist on the back surface of the protrusion 8. Even if the motor for driving the screw 6 to rotate continues to be turned while the assist ball 7 is at the retreat position, an impulsive force of the carriage 3 can be released. Therefore, a sensor for stopping the carriage 3 is not required.

Figure 6A:
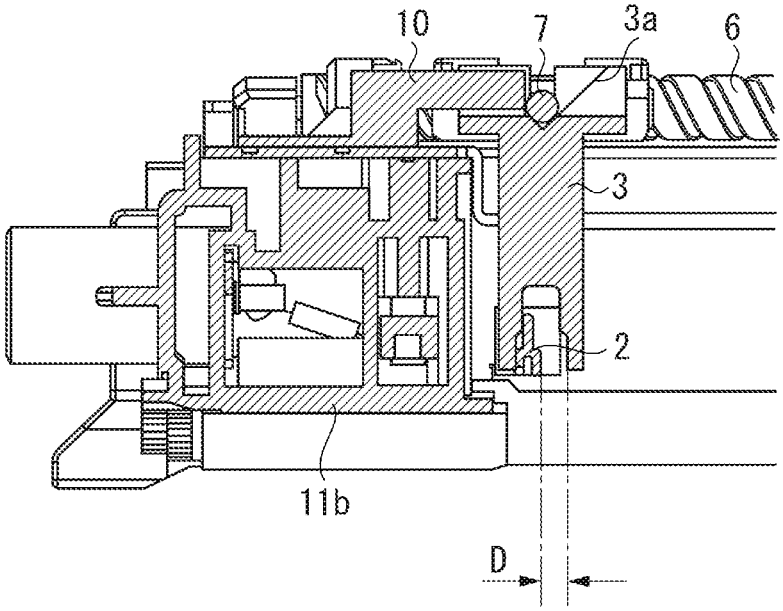
FIGS. 6A and 6B are a side view and a top view illustrating the carriage according to the exemplary embodiment.
Figure 6B:
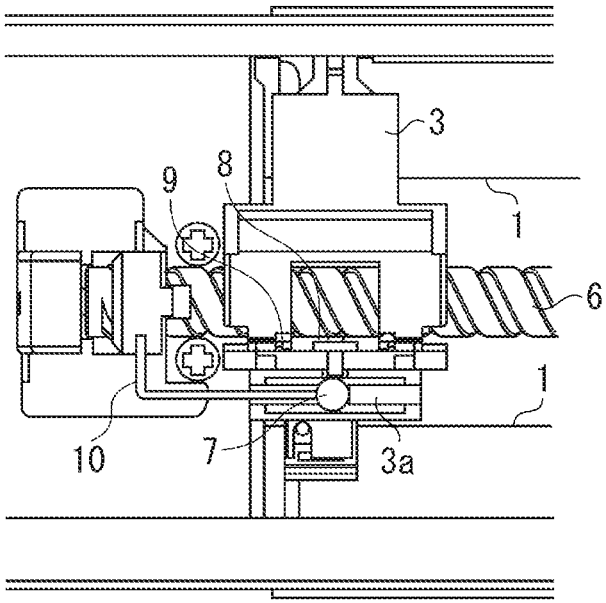

FIG. 6A is a sectional side elevation in a state where the carriage 3 is operated slightly toward the front block 11*a* from a state where the carriage 3 abuts on the rear block 11*b*. FIG. 6B is a top plan view of FIG. 6A. Since the assist guide 3*a* has a V shape, the assist ball 7 rolls on an inclined plane of the assist guide 3*a* to return to the V-shaped valley portion as the carriage 3 separates from the rear block 11*b*. The protrusion 8 can be relieved of the screw 6 until the assist ball 7 completely moves to the V-shaped valley portion. If a certain force or more is applied to the carriage 3 immediately after the operation of the carriage 3 is reversed, therefore, the carriage 3 stops there. A clearance D is provided between the carriage 3 and an attachment portion of the cleaning pad 2 in the operation direction of the carriage 3. A distance E illustrated in FIGS. 5A and 5B is the distance the retreat plate 10 moves the assist ball 7. The clearance D is made equal to or more than the distance E, so that the load received from the cleaning pad 2 can be eliminated until the assist ball 7 completely returns to the V-shaped valley portion. Thus, operation failure immediately after the operation of the carriage 3 is reversed can be prevented from occurring. Here, the clearance D is set to 3.5 mm, and the distance E is set to 3 mm.

Figure 7:
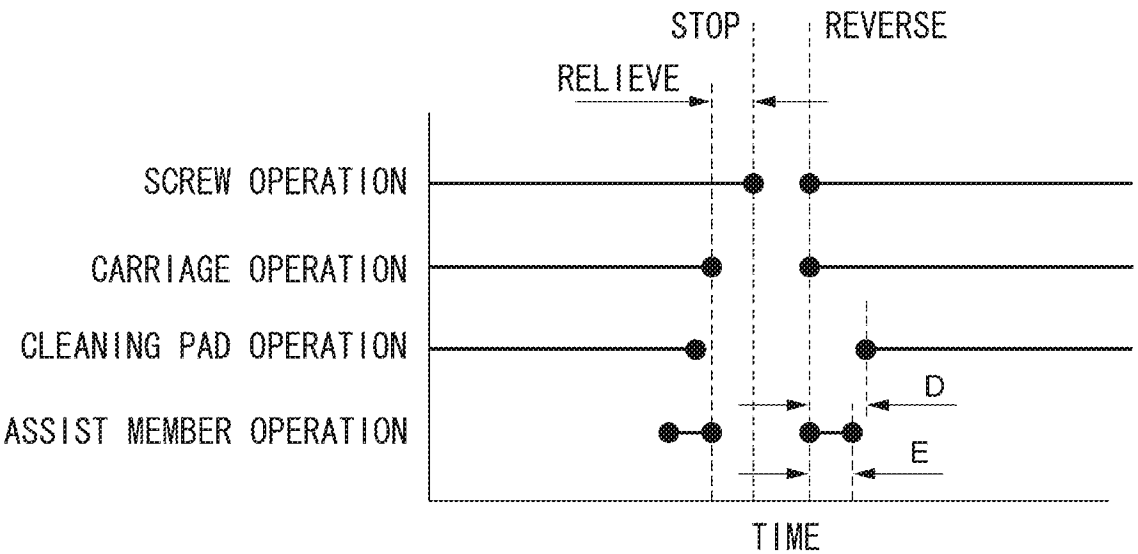
FIG. 7 is a timing chart illustrating an operation of an assist ball according to the exemplary embodiment.
Figure 8A:
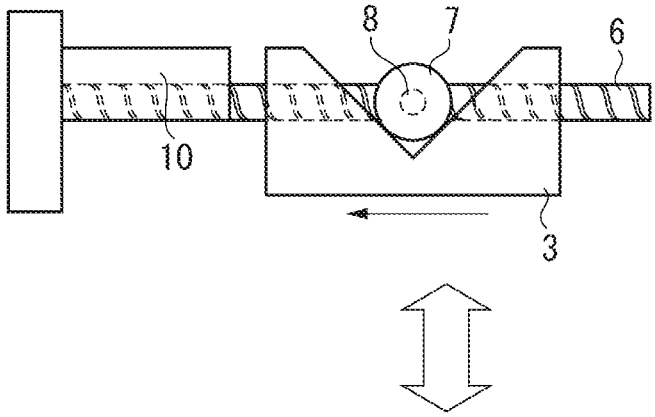
FIGS. 8A, 8B, and 8C are schematic views for illustrating an operational relationship according to the exemplary embodiment.
Figure 8B:
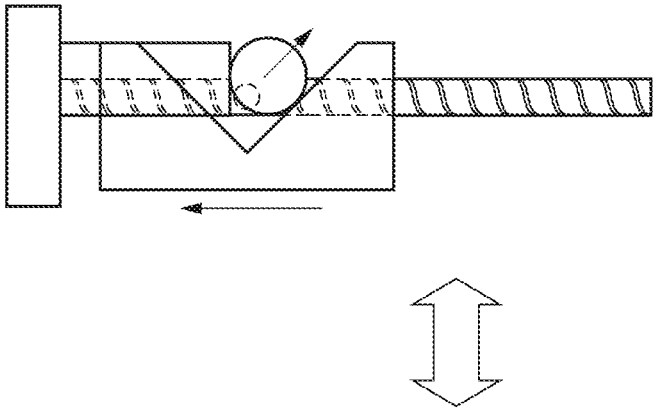
Figure 8C:
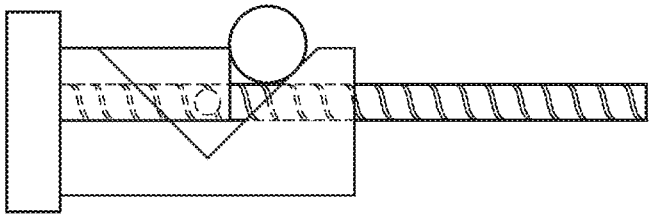

An operation of the assist ball 7 having the above described configuration will be described below. FIG. 7 is a timing chart for easily grasping an operation relationship, at the end of the screw 6, of the assist ball 7 in the above-mentioned configuration. In FIG. 7, time is plotted on the horizontal axis, and operations of elements such as the carriage 3, the cleaning pad 2, and the assist ball 7 performed when the screw 6 is driven to rotate are plotted on the vertical axis. FIGS. 8A, 8B, and 8C are schematic views for simply illustrating an operation of the assist ball 7 at the end of the screw 6.

When the carriage 3 exists at the end of the screw 6, the assist ball 7 moves to an upper part of the V-shaped groove in contact with the member. When a force exceeding an urging force of the plate spring 9 is exerted on the carriage 3, therefore, the carriage 3 jumps (see FIG. 8C). When the carriage 3 exists outside of the end, the assist ball 7 moves to a lower part of the V-shaped groove (the regulation position) under its own weight. Therefore, the assist ball 7 causes the protrusion 8 and the screw 6 not to jump (see FIG. 8A). In other words, when the assist ball 7 serving as a regulation member exists at the retreat position, the assist ball 7 does not regulate the width in which the plate spring 9 is displaceable. When a predetermined force or more is exerted on the carriage 3 while the assist ball 7 exists at the retreat position, therefore, the plate spring 9 is more greatly displaced than a difference between the concave and convex portions of the helical groove 6*a* of the screw 6 to generate jumping.

The carriage 3, which holds the cleaning pad 2, remains still at a waiting position at an end of the charging wire 1 except when a wire cleaning operation is performed, not to affect charging of the photosensitive member or the like.

The spring constant of the plate spring 9, which supports the protrusion 8, is made higher than that in a conventional configuration so that unintended jumping of the carriage 3 at the center of the screw 6 can be avoided. When the spring constant is increased, however, the protrusion 8 is greatly ground in proportion to the spring constant when an impulsive force generated by the screw 6 is released at the end of the screw 6.

An amount of grind can be reduced by using a member resistant to cutting such as a metal for the protrusion 8. However, the corona charging device P1 applies a high voltage, so that leakage due to ground powder may occur. Therefore, it is difficult to adopt a metal for the protrusion 8 that receives a driving force from the helical groove 6*a* of the screw 6. Therefore, polyethylene terephthalate (PET) is used as a non-conductive resin material with respect to a site, which abuts on the screw 6, of the carriage 3, and a member having a desired shape is obtained by molding the PET.

In the present exemplary embodiment, the cleaning pad for cleaning the charging wire 1 serving as a charging electrode has been taken as an example. The screw 6 may move the cleaning member configured to clean the charging device in a longitudinal direction. A similar configuration may be applied to the carriage 3 configured to move a cleaning brush for cleaning a grid serving as a charging electrode in a longitudinal direction of the corona charging device P1.

Figure 9:
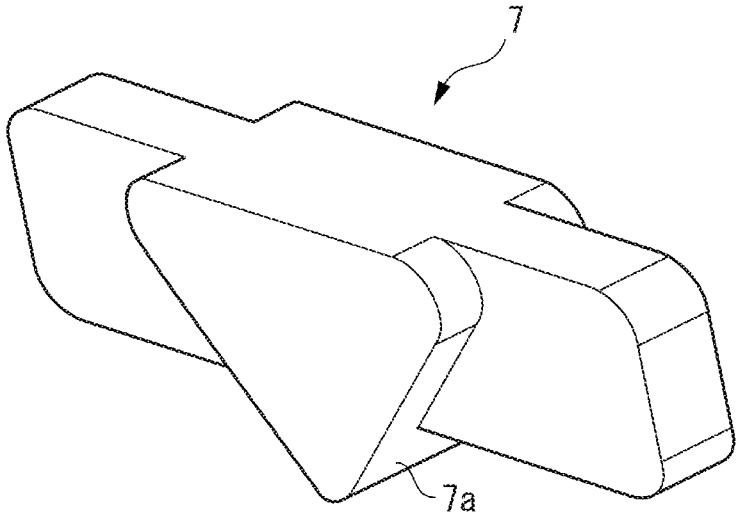
FIG. 9 is a detail view illustrating an assist plate according to the exemplary embodiment.

A second exemplary embodiment will be described. In the first exemplary embodiment, the spherical assist ball 7 has been taken as an example of a regulation member. In the present exemplary embodiment, the spherical member is replaced with an assist plate 7 serving as a regulation member, as illustrated in FIG. 9. FIGS. 10A and 10B and FIGS. 11A and 11B illustrate an operation performed when the assist ball 7 is replaced with the assist plate 7. The present exemplary embodiment is substantially the same as the configuration discussed in the first exemplary embodiment except for the shape of the regulation member. Therefore, the same portions are assigned the same reference numerals for simplicity, and hence description thereof is not repeated.

Figure 10A:
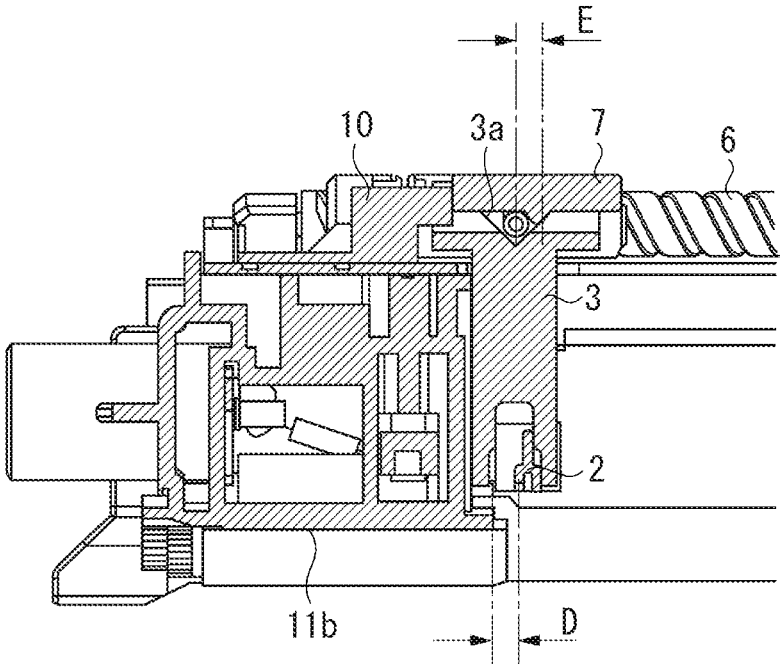
FIGS. 10A and 10B are a side view and a top view illustrating a carriage according to the exemplary embodiment.
Figure 10B:
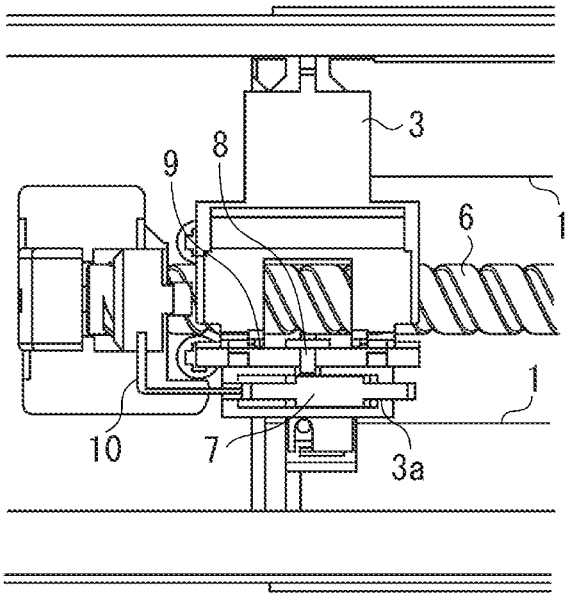

FIG. 10A is a sectional side elevation, at an end of a screw 6, of a corona charging device P1 using the plate-shaped member illustrated in FIG. 9 as an assist plate. FIG. 10B is a top view, at the end of the screw 6, of the corona charging device P1 as looked down from above.

It is configured such that when a carriage 3 reaches a position where it abuts on a rear block 11*b*, a retreat plate 10 provided above the rear block 11*b* enters a slit of an assist rail 3*a*, to push away the assist plate 7 from a back surface of a protrusion 8. The protrusion 8 can be relieved of the screw 6 if the assist plate 7 does not exist on the back surface. Even if a motor for driving the screw 6 to rotate continues to be turned in this state, an impulsive force generated by the carriage 3 can be released. Therefore, a sensor for stopping the carriage 3 is not required.

Figure 11A:
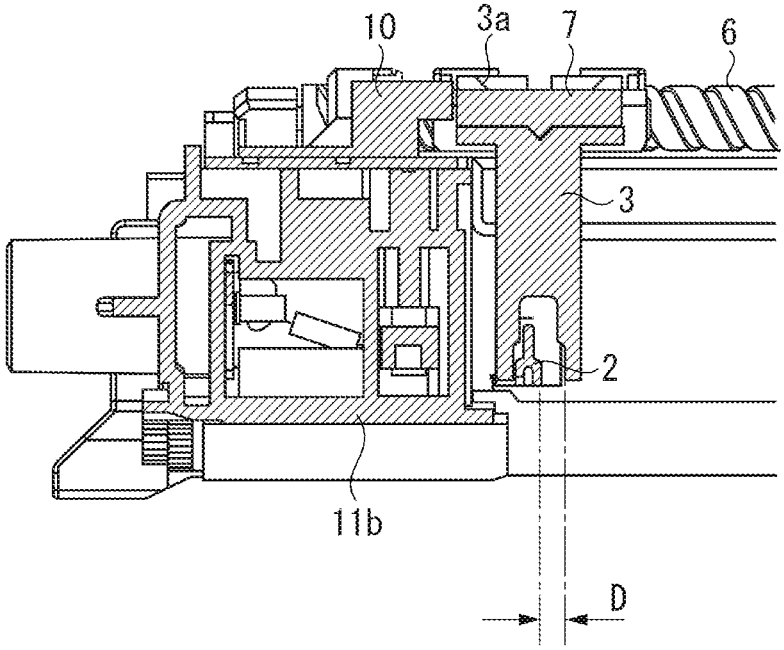
FIGS. 11A and 11B are a side view and a top view illustrating the carriage according to the exemplary embodiment.
Figure 11B:
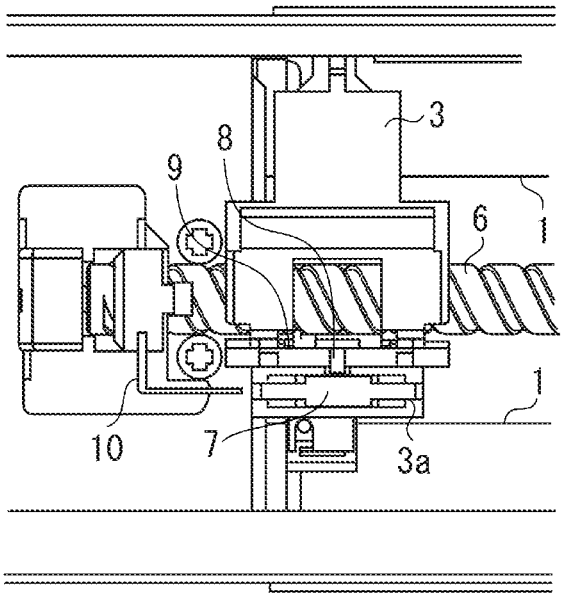

FIG. 11A is a sectional side elevation of the corona charging device P1 for illustrating an operation performed when the carriage 3 is returned at the end of the screw 6. FIG. 11B is a top view, at the end of the screw 6, of the corona charging device P1 as looked down from above. An operation performed when the carriage 3, which has moved to the end of the screw 6, is moved in an opposite direction will be described.

Since the assist guide 3*a* has a V shape, the assist plate 7 returns to a V-shaped valley portion while sliding by friction against a frictional sliding surface 7*a* and a V-shaped inclined plane of the assist guide 3*a* as the carriage 3 separates from the rear block 11*b*. The protrusion 8 can be relieved of the screw 6 until the assist plate 7 completely moves to the V-shaped valley portion. If a certain force or more is applied to the carriage 3 immediately after the operation of the carriage 3 is reversed, therefore, the carriage 3 stops there. A clearance D is provided between the carriage 3 and an attachment portion of the cleaning pad 2 in the operation direction of the carriage 3. In the present exemplary embodiment, the assist plate 7, which has separated from the retreat plate 10, moves toward the V-shaped valley portion (a regulation position) of the assist guide 3*a* using its own weight as an urging force. The assist plate 7 is easily configured if gravity exerted on the assist plate 7 is used as an urging force. However, an urging member such as a spring for urging the assist plate 7 toward the valley portion may be separately provided to ensure the stability of the operation.

A distance E illustrated in FIGS. 10A and 11A is the distance the retreat plate 10 serving as a retreat member moves the assist plate 7 serving as a regulation member. The clearance D is made equal to or more than the distance E, so that the load received from the cleaning pad 2 can be eliminated until the assist plate 7 completely returns to the V-shaped valley portion. Thus, operation failure immediately after the operation of the carriage 3 is reversed can be prevented from occurring.

While a configuration in which the carriage 3 moves the cleaning pad for cleaning the charging wire 1 has been described in the present exemplary embodiment, the present exemplary embodiment may be applied to a configuration in which a cleaning brush serving as a cleaning member configured to clean a grid electrode serving as a charging electrode is moved in a longitudinal direction. The cleaning pad and the cleaning brush may be integrally supported on the carriage 3 and moved in a longitudinal direction. Even if a pressure force of the cleaning pad to the charging wire 1 is increased and an amount of abrasive particles contained in the cleaning pad is increased to reduce the frequency of cleaning the charging electrode, a force required to move the cleaning pad in the longitudinal direction is increased. In this case, there also occurs a similar situation to that occurring when the degree of dirt is aggravated if a high voltage is applied to the charging electrode.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-171995 filed Aug. 5, 2011, which is hereby incorporated by reference herein in its entirety.

What is claimed is:

1. A charging device comprising:

a corona charging device including a charging electrode;

a cleaning member for cleaning the charging electrode;

a screw;

a carriage including an engagement portion that engages with a concave portion of the screw, an urging member for urging the engagement portion toward the screw, and a regulation member for regulating deformation of the urging member, wherein the carriage moves the cleaning member in a longitudinal direction of the corona charging device as the screw rotates; and a retreat member configured to abut on the regulation member at an end of the screw and retreat the regulation member from a regulation position to a retreat position, wherein the urging member is regulated not to be displaceable greater than a difference between the concave portion and a convex portion of the screw when the regulation member is at the regulation position, and is displaceable greater than the difference between the concave portion and the convex portion of the screw when the regulation member is at the retreat position.

2. The charging device according to claim 1, wherein the regulation member moves to the regulation position under its own weight in a state where the retreat member does not abut on the regulation member.

3. The charging device according to claim 1, wherein the engagement portion in the carriage is a non-conductive resin material.

4. The charging device according to claim 1, wherein the charging electrode includes a charging wire and a grid, and wherein the carriage integrally supports a cleaning pad for cleaning the charging wire and a cleaning brush for cleaning the grid.

* * * * *